US005987299A

United States Patent [19]

Kopp et al.

[11] Patent Number: 5,987,299

[45] Date of Patent: Nov. 16, 1999

[54] ELECTROGRAPHIC PRINTER WITH ADJUSTABLE CORONA DEVICE

[75] Inventors: Walter Kopp; John Heinz; Otto Olbrich, all of Bundesrepublik, Germany

[73] Assignee: Oce Printing Systems GmbH, Poing, Germany

[21] Appl. No.: 09/051,149

[22] PCT Filed: Jun. 27, 1996

[86] PCT No.: PCT/DE96/01145

§ 371 Date: Jul. 16, 1998

§ 102(e) Date: Jul. 16, 1998

[87] PCT Pub. No.: WO97/14080

PCT Pub. Date: Apr. 17, 1997

[30] Foreign Application Priority Data

Oct. 9, 1995 [DE] Germany ..... 195 37 610
Oct. 27, 1995 [DE] Germany ..... 195 40 166

[51] Int. Cl.[6] ..... G03G 15/00

[52] U.S. Cl. ..... 399/384; 399/311

[58] Field of Search ..... 399/384, 169, 399/170, 311, 204, 391; 271/9.1, 9.12

[56] References Cited

U.S. PATENT DOCUMENTS

| | | | |
|---|---|---|---|
| 3,578,970 | 5/1971 | Michaud et al. . | |
| 3,827,799 | 8/1974 | Koizumi | 399/169 |
| 4,208,666 | 6/1980 | Paranjpe | 347/104 |
| 5,337,131 | 8/1994 | Sagiv et al. | 399/170 |
| 5,539,508 | 7/1996 | Piotrowski et al. | 399/170 |
| 5,546,178 | 8/1996 | Manzer et al. | 399/384 |
| 5,568,245 | 10/1996 | Ferber et al. | 399/384 |

FOREIGN PATENT DOCUMENTS

| | | |
|---|---|---|
| 58-033276 | 2/1983 | Japan . |
| 58-187969 | 11/1983 | Japan . |
| WO 94/27193 | 9/1994 | WIPO . |

OTHER PUBLICATIONS

Patent Abstracts of Japan Publication No. JP4174480, dated Jun. 22, 1992 (Takeshi).

Patent Abstracts of Japan Publication No. JP58172667, dated Oct. 11, 1983 (Kazuhiro).

*Primary Examiner*—Robert Beatty
*Attorney, Agent, or Firm*—Hill & Simpson

[57] ABSTRACT

An electrographic printer with a printing unit that comprises a photoconductor provided with a toner image during the printing process and which further comprises a corona device arranged at a distance from the photoconductor that generates an electrical field during the printing process for transferring the toner image onto an endless carrier material is provided. The printer, in a first operating mode, can print a first web section of the endless carrier material conducted along a transport path and, in a second operating mode, can simultaneously print a second web section conducted along a parallel transport path and arranged next to the first web section at a distance therefrom. The length of the electrical field generated by the corona device is adjustable according to whether a first web section or a first and second web section is transported along the transport path.

16 Claims, 6 Drawing Sheets

ELECTROGRAPHIC PRINTER WITH ADJUSTABLE CORONA DEVICE

FIELD OF THE INVENTION

The invention is directed to an electrographic printer with a printing unit that comprises a photoconductor provided with a toner image during the printing process and comprises a corona device arranged at a distance from the photoconductor that generates an electrical field during the printing process for transferring the toner image onto an endless carrier material, whereby the printer—in a first operating mode—can print a first web section of the endless carrier material conducted along a transport path and—in a second operating mode—can simultaneously print a second web section conducted along a parallel transport path and arranged next to the first web section at a distance therefrom.

BACKGROUND OF THE INVENTION

The invention is concerned with an improvement of an electrographic printer means for printing web-shaped recording media of different web width according to WO 94/27193. The printer means disclosed therein has an electrographically working intermediate carrier, for example, a photoconductor drum, having a usable width corresponding to twice the width format of a standard form according to DIN A4 or twice the width of standard letter size format. The further units, such as the fixing station, the developer station, the cleaning station, etc., are likewise designed for this usable width.

Various operating modes are possible with this known printer means. In what is referred to as the simplex mode, thus, a recording medium having up to twice the width of a DIN A4 sheet or of a sheet in letter size format can be printed in a traditional form. In a parallel simplex mode, two narrow recording media arranged side-by-side, for example having a width according to DIN A4, can be conducted through the printer means and be printed in juxtaposed position.

In a further operating mode, the single-color duplex mode, the web of the recording medium is turned over during transport through the printer means, so that two web sections derive in a first web section, the front side of the web resides opposite the transfer printing location of a printing unit, whereas the back side of the web in a second web section is simultaneously printed at the same transfer printing location. A two-color duplex mode is also possible by employing differently colored ink particles in different developer units of the printing unit.

In another operating mode, the two-color simplex mode, the web is offset parallel by at least one web width during transport in the printer means, and the offset web sections are conducted past the transfer printing station in common in juxtaposed position. In the first pass of the web past the transfer printing location, image and text elements are printed with a first color; in the second pass of the web with offset, image and text elements are printed with the second color.

The printer means disclosed by WO 94/27193 works according to the principle of electrophotography, whereby a photoconductor on which a latent charge image corresponding to the print format to be printed is applied with the assistance of a light source, for example a laser or an LED line, is employed as intermediate carrier. Ink particles of a desired color are transferred onto the photoconductor within a developer station arranged close to the photoconductor and the charge image is inked with toner particles. The developer station is followed by the printing unit in which a corona device, arranged at a distance from the photoconductor, transfers the toner image onto the endless carrier material passing through between photoconductor and corona device with an electrical field. To this end, the air between the corona device and the endless carrier material is ionized by high field strengths, as a result whereof charge carriers are generated on that side of the endless carrier material facing away from the photoconductor. An electrostatic force field thereby arises between endless carrier material and photoconductor, as a result whereof the toner image situated on the photoconductor is transferred onto the endless carrier material.

Since the printer of the species initially cited can print web sections of different width from endless carrier material, only a section of the photoconductor corresponding to the widths of the web section is covered by the endless carrier material when printing a web section of less width, whereas the section that is not covered is exposed to the electrical field of the corona device unprotected. Due to the strong electrical field, the section of the photoconductor that is not covered is highly charged compared to the section covered by the endless carrier material, so that an extremely great difference in potential arises between the photoconductor sections that are covered by the endless carrier material and the photoconductor section that is not covered. These great fluctuations in potential deteriorate the quality of the print image, which appears, for example, given gray rasters or large-area print images, which make a non-uniform impression. Further, a uniform charging of the photoconductor over its entire width is not longer possible due to the great differences in potential, and the photoconductor is made unusable for a longer time due to the uncontrolled charging.

Width-adjustable transfer coronas are notoriously known. Thus, JP-A-4-174480 provides a length-adjustable corona wire that is stretched via an electrode roller and an insulator roller and is moved together with a non-conductive wire. JP-A-58/172667 shows two predetermined sections wherein the field width can be registered via an opposing voltage applied to shielding lattices. U.S. Pat. No. 3,578,970 shows corona wires that are stretched between a stationary block and a displaceable block. The field width set corresponds to the spacing between the two plates secured to the blocks.

SUMMARY OF THE INVENTION

An object of the invention is to offer an electrographic printer whose photoconductor transfers toner images onto the endless carrier material with high quality.

This object is achieved by an electrographic printer with a printing unit that comprises a photoconductor provided with a toner image during the printing process and comprises a first corona device arranged spaced from the photoconductor that generates a first electrical field with adjustable field width during the printing process for transferring the toner image onto an endless carrier material, whereby the printer can optionally print a first web section of the endless carrier material in a first operating mode and can simultaneously print a second web section arranged next to the first web section spaced therefrom in a second operating mode, and whereby the field width of the first corona device can be set to the width of the first web section in the first operating mode.

The electrographic printer of the invention comprises a first corona device that generates a first electrical field during the printing process whose field width, i.e. the effective width of the electrical field that influences the photoconductor, can be set to the width of the first web section of the endless carrier material to be printed. In this way, it is possible to prevent an influence of the electrical field onto the sections of the photoconductor that are not covered by the endless carrier material. As a result thereof, a non-uniform charging of the photoconductor and a difference in potential connected therewith between the sections of the photoconductor that are covered by the endless carrier material and the sections of the photoconductor that are not covered is prevented. Since the fluctuations in potential at the photoconductor are slight, a high quality, homogeneous, uniform toner image can be generated on the photoconductor surface. The image is then transferred onto the endless carrier material during the printing process.

In an embodiment the field width of the electrical field is is varied by employing a shield element composed of an electrically insulating material that is arranged between the corona device and the photoconductor. The corona device thereby generates an electrical field that acts over the entire width of the photoconductor. Whereas the section of the photoconductor covered by the endless carrier material is shielded by the endless carrier material, the section of the photoconductor that is not covered is protected by the shield element. To this end, the shield element is adjustable in length parallel to the longitudinal axis of the photoconductor and can be matched to the width of the web section to be printed. Given employment of a corona device wherein the electrical field is generated with a wire, the field width can be matched to the width of the web section to be printed by lengthening or shortening the wire, since the field width of the electrical field is determined by the length of the tensed wire.

The adjustment of the field width can be performed manually by the operator of the electrographic printer. It is also conceivable to acquire the width of the web section to be printed using sensors and to automatically set the field width of the corona device to the correct value.

In a preferred embodiment, a second corona device arranged in juxtaposed position is employed in addition to the first corona device, this second corona device generating a second electrical field with adjustable field width approximately corresponding to the width of a second web section in the second operating mode in which two web sections arranged spaced side-by-side are simultaneously printed. As a result thereof, it is possible to simultaneously print web sections of different widths without having an electrical field influence the uncovered section of the photoconductor.

In another preferred embodiment, the field width of the first corona device in the second operating mode approximately corresponds to an overall width that derives from the widths of the first and second web section and the space between the web sections. In order to protect the photoconductor against the electrical field in the region between the web sections that is not covered by the endless carrier material, a shield means with adjustable shield width is provided between the web sections. It is especially advantageous when the shield width of the shield means corresponds to the spacing between the web sections, since the web sections can thus be printed over their entire respective width, on the one hand, and the photoconductor, on the other hand, is protected against the electrical field.

In a further embodiment, the shield means has two booms adjustable parallel to the longitudinal axis of the photoconductor at whose ends facing toward the photoconductor a respective shield element composed of an electrically insulating material is provided. The shield elements are arranged between photoconductor and first corona device and preferably overlap one another. To this end, the booms can be provided at the adjustable transport devices that, arranged between the web sections, transport the first or, respectively, second web section and that must be positioned according to the width of the web section before every print job. A further possibility is to employ a shield means that is secured to the frame of the printer and whose boom can be adjusted parallel to the longitudinal axis of the photoconductor either manually, for example with the assistance of a crank, or automatically via actuators. Given employment of actuators, it is also possible to acquire the width of each web section with sensors and to automatically set the booms with the shield elements secured thereto according to the shielding width.

The employment of a shield means that has a foil composed of an electrically insulating material is especially advantageous, said foil being adjustable in length parallel to the longitudinal axis of the photoconductor according to the spacing between the web sections. The foil can thereby have its one end secured to the first adjustable transport device, whereas the other end is wound in a cassette secured to the second adjustable transport device. When the spacing between the transport devices is changed, the foil is pulled from the cassette or, respectively, wound into it.

Each corona device preferably has a cassette arranged to the side of each web section with a corona wire that can be wound up in the cassette. The corona wire is secured to a slide element or anchor element and can be stretched parallel to the longitudinal axis of the photoconductor with the slide. The unwound length of the corona wire thereby determines the field width of the electrical field. It is especially advantageous when a cleaning means that cleans the corona wire while it is being unwound from and wound into the cassette is provided in the cassette. This cleaning process, for example, can be implemented at the beginning of every printing event.

In an especially preferred embodiment, each corona device has its own voltage supply. As a result thereof, it is possible to match the intensity of the electrical field to the endless carrier material of the first or, respectively, second web section. This is especially important when the properties of the material of the first and second web section differ from one another and different voltages are required for a qualitatively high-grade printing. Such differences in material derive, for example, given both-sided printing, whereby the endless carrier material is printed on the front side as first web section, is subsequently conducted through the fixing station and, finally, is supplied turned over the printer as second web section in order to print the back side. The material properties of the endless carrier material change due to the fixing in the fixing station, so that the voltage must be increased in order to be able to generate a high-quality print image.

In an embodiment, the present invention provides an electro-graphic printer that comprises a printing unit comprising a photo-conductor for transmitting a toner image to a carrier material. The photo-conductor has an overall width. The printing unit further comprises a corona device comprising a corona wire having a length that is adjustable from a longer distance about equal to the overall length of the photo-conductor to a shorter distance that is less than or equal to the width of the web of the carrier material. The corona wire is spaced from the photo-conductor. The printer further comprises four tractor drives including first, second, third and fourth tractor drives arranged longitudinally along the photo-conductor. The second tractor drive is adjustably spaced from the first tractor drive thereby enabling the first and second tractor drives to engage opposing edges of a first section of the web and to feed said first section of the web between the corona wire and the photo-conductor. The third tractor drive being adjustably spaced from the fourth tractor drive thereby enabling the third and fourth tractor drives to engage opposing edges of a second section of the web and to feed said second section of the web between the corona wire and the photo-conductor. The third and fourth tractor drives being spaced from the first and second tractor drives thereby enabling the first and second sections of the web to be fed between the corona wire and the photo-conductor simultaneously. Because the third tractor drive is spaced from the second tractor drive with a gap disposed therebetween, a shield is provided between the second and third tractor drives with an adjustable shield width. The shield is disposed between the corona wire and the photo-conductor.

It is therefore an advantage of the above-described embodiment to prevent an electrical field generated by the corona wire from directly engaging the photo-conductor. The above embodiment either includes carrier material disposed between the corona wire and the photo-conductor or a shield element disposed between the corona wire and the photo-conductor.

In an embodiment, the corona wire is adjustable to extend laterally across from the first tractor drive to the second tractor drive as well as from the first tractor drive to the fourth tractor drive.

In an embodiment, the second tractor drive can be spaced laterally across the width of the photo-conductor and the third and fourth tractor drives can be disposed past a distal end of the photo-conductor so that a web of carrier material having an extra-wide width can be accommodated between the first and second tractor drives with the third and fourth tractor drives being deactivated.

In an embodiment, the shield comprises a boom connected to the second tractor drive. The boom being connected to a shield element comprising an electrically insulating material that extends between the corona wire and a longitudinal axis of the photo-conductor.

In an embodiment, the shield element has a length that is adjustable or, the shield element is telescopically adjustable.

In an embodiment, the shield comprises a first boom that is connected to the second tractor drive and a second boom that is connected to the third tractor drive. The first and second booms are connected to first and second shield elements respectively that extend toward one another and overlap to thereby provide protection for the photo-conductor portion that is disposed between the second and third tractor drives.

In an embodiment, the first and second shield elements are length-adjustable or telescopically adjustable.

In an embodiment, the corona device comprises a cassette for accommodating the corona wire on a spring-loaded winding. The corona wire has a distal end that is connected to a slide element. The corona wire and the slide element are extendable along the photo-conductor thereby enabling the corona wire to be extendable from the first tractor drive to the second tractor drive or from the first tractor drive to the fourth tractor drive.

In an embodiment, the slide element is selectively attachable to either the second tractor drive or the fourth tractor drive.

In an embodiment, the cassette comprises a cleaning element that engages the corona wire and cleans the corona wire as it is extended outward from the cassette and is retracted inward into the cassette.

In an embodiment, instead of a single corona device with a corona wire that extends longitudinally along the photo-conductor, two corona devices are provided and are disposed on opposing ends of the photo-conductor so that a first corona device with a first corona wire extends between the first and second tractor drives and a second corona device with a second corona wire extends between the fourth and third tractor drives. Accordingly, the section of the photo-conductor disposed between the second and third tractor drives is not exposed to a corona wire and therefore no additional shielding element for this middle section of the photo-conductor is required.

Other objects and advantages of the present invention will become apparent from reading the following detailed description and appended claims, and upon reference to the accompanying drawings.

BRIEF DESCRIPTION OF THE DRAWINGS

Exemplary embodiments of the invention are explained below on the basis of drawings. Shown therein are.

Figure 1:
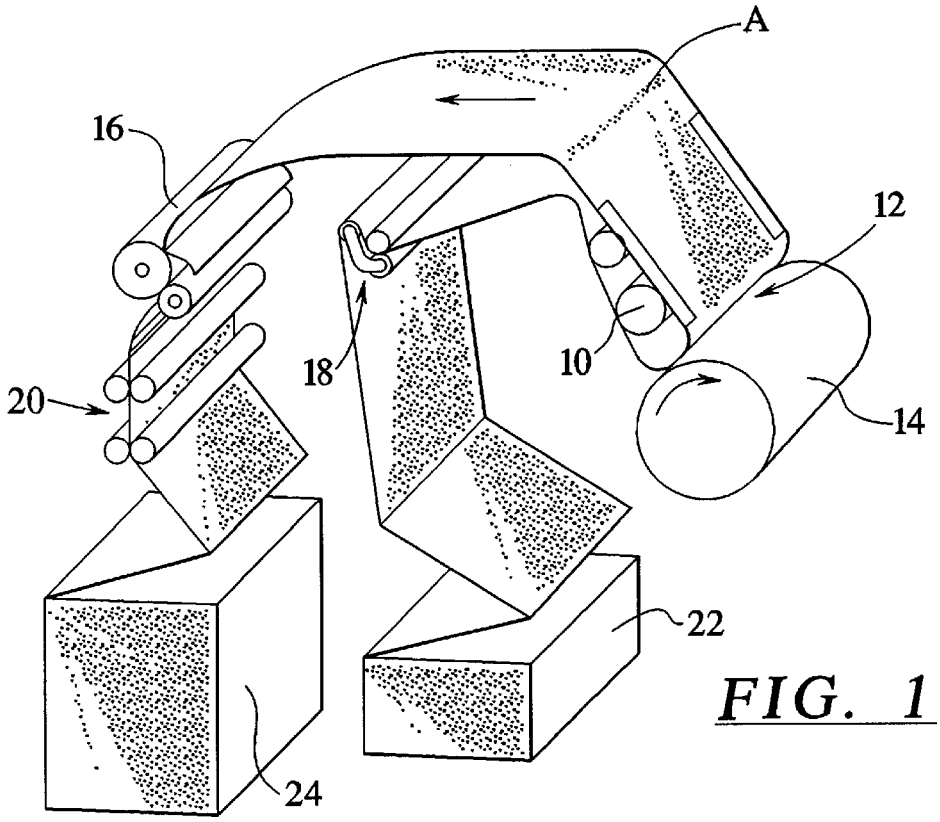
FIG. 1 is a schematic illustration of a printer that works in the simplex mode.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Details of the invention are described below upon employment of a high-performance printer that works in various operating modes that are shown in FIGS. 1 through 4. The printer has a transport device 10 that, arranged close to a printing unit 12, transports endless carrier material through the printing unit 12 in which the charge image that is applied onto a photoconductor drum 14 and inked with toner is transferred onto the endless carrier material with a corona device (not shown). Subsequently, the endless carrier material is supplied to a fixing station 16 in which the still smearable toner image on the endless carrier material is joined smear-proof to the endless carrier material with the assistance of pressure and temperature. As viewed in transport direction, a first deflection unit 18 is arranged in front of the printing unit 12, this first deflection unit 18 supplying the endless carrier material to the printing unit 12 and being capable of turning the endless carrier material over (see FIG. 3) or merely laterally displacing it as well (see FIG. 4) according to the selected operating mode. As viewed in transport direction, a second deflection unit 20 is arranged following the fixing station 16. This second deflection unit 20 stacks the printed endless carrier material and, likewise dependent on the selected operating mode, can also supply the material to the first deflection unit 18, as shall be explained later.

FIG. 1 shows the printer in a first operating mode, the simplex mode, whereby a first web section A of the endless carrier material from a stack 22 is supplied to the printing unit 12 by the first deflection unit 18. After the printing, the transport device 10 transports the web section A in the direction of the fixing station 16 in which the toner image is joined fixed to the endless carrier material. Subsequently, the second deflection unit 20 stacks the web section A on a second stack 24.

Figure 2:
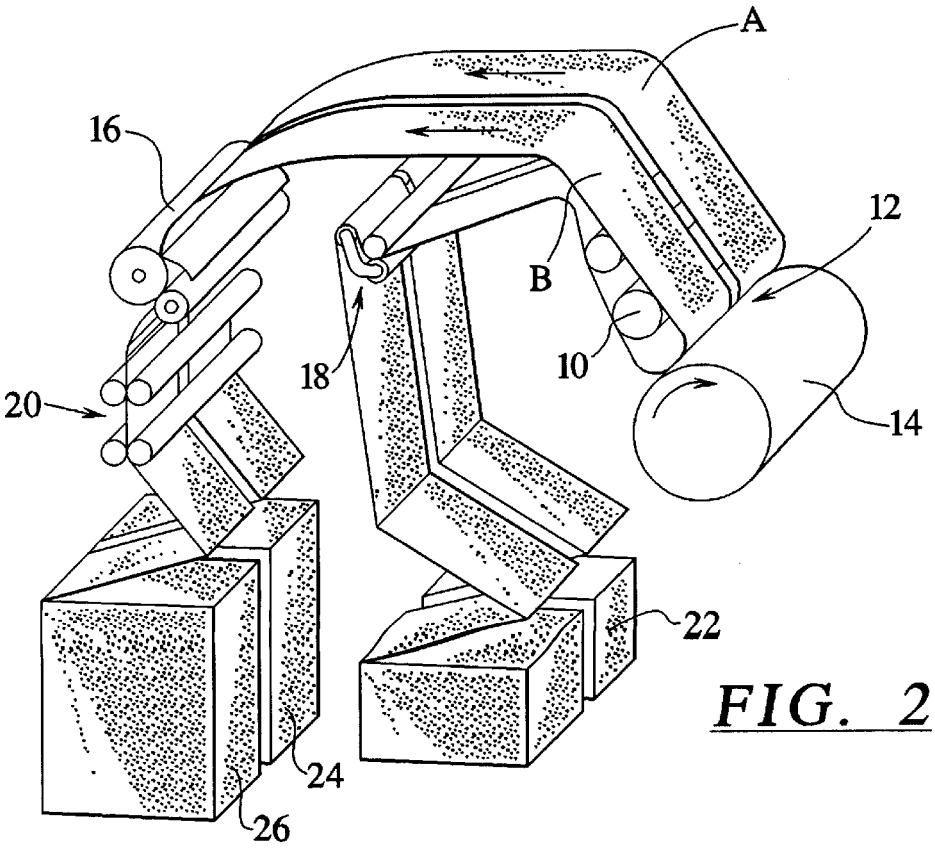
FIG. 2 is a schematic illustration of the printer according to FIG. 1 that works in the parallel simplex mode.

FIG. 2 shows the printer in a second operating mode, the parallel simplex mode, in which a first web section A and a second web section B arranged next to it is simultaneously conducted through the printing unit 12 and the fixing station 16 and is subsequently stacked onto two stacks 24 and 26 by the second deflection unit 20.

Figure 3:
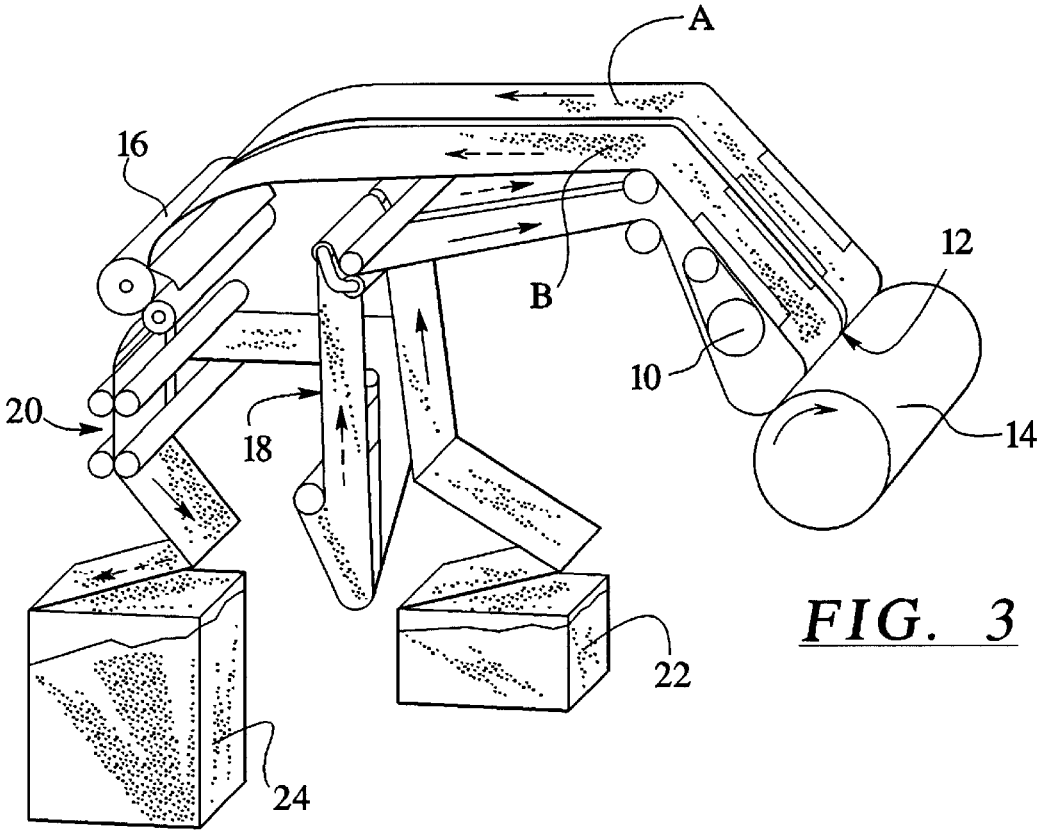
FIG. 3 is a schematic illustration of the printer according to FIG. 1 that works in the duplex mode.

FIG. 3 shows a third operating mode of the printer, the duplex mode, wherein the endless carrier material is printed on the front and back side. To this end, the endless carrier material is supplied to the printing unit 12 in a first web section A proceeding from a first stack 22. After the printing, the first web section A is conducted through the fixing station and subsequently supplied to the first deflection unit 18 by the second deflection unit 20. The first deflection unit 18 turns the endless carrier material over and displaces it laterally by advantageously least one web width, so that the back side of the endless carrier material can now be supplied to the printing unit 12. After being turned over, the endless carrier material is referred to as second web section B. When the second web section B has passed through the printing unit 12 and the endless carrier material carries a second print image on its back side, it is supplied to the fixing station the joins the print image on the back side of the endless carrier material smear-proof to the surface of the endless carrier material. After the end of the fixing process, the endless carrier material is stacked up in the form of a stack 24.

Figure 4:
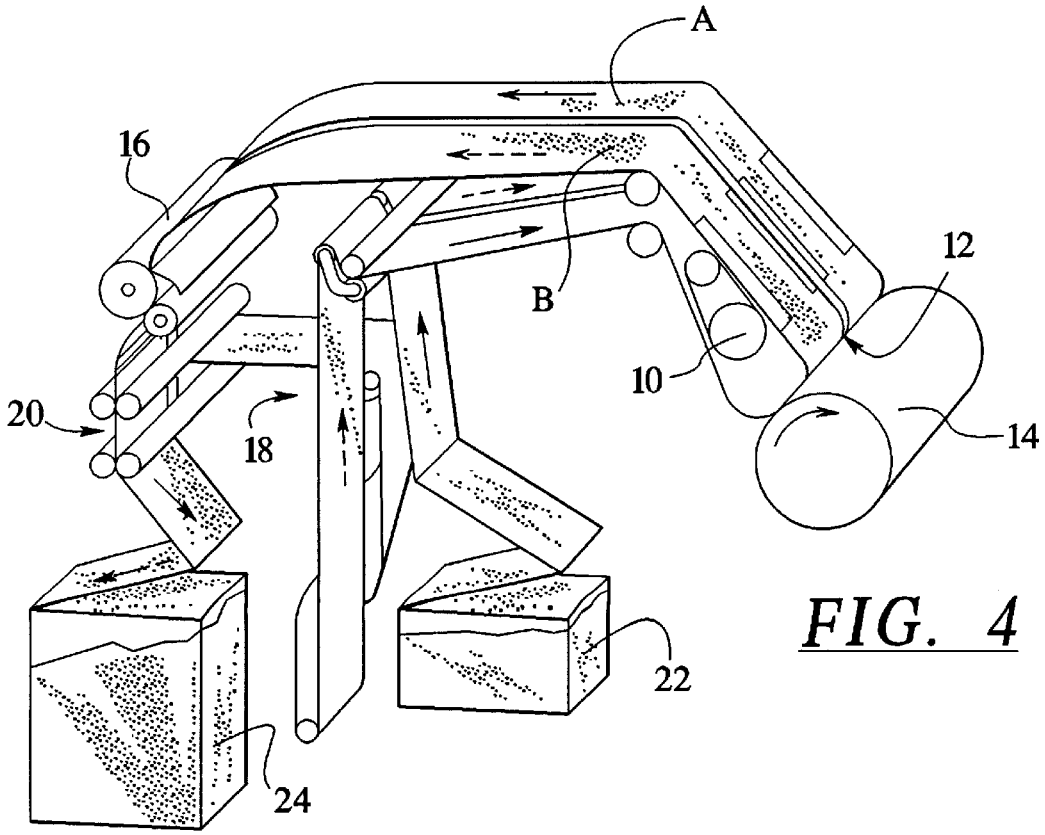
FIG. 4 is a schematic illustration of the printer according to FIG. 1 that works in the two-color simplex mode.

FIG. 4 shows a fourth operating mode, the two-color simplex mode, wherein the front side of the endless carrier material is first printed in a first color and is printed in a second color in a second printing pass following thereupon. To this end, the endless carrier material is supplied to the printing unit 12 as first web section A with the assistance of the first deflection unit 18. After the endless carrier material is printed by the printing unit 12, the transport device 10 transports the endless carrier material into the fixing station 16 in order to join the toner image fixed to the endless carrier material. After the end of the fixing process, the endless carrier material is resupplied by the second deflection unit 20 to the first deflection unit 18 that conducts the endless carrier material to the printing unit 12 laterally displaced by at least one web width. After the displacement of the endless carrier material by the first deflection unit 18, the section of the endless carrier material is referred to as second web section B. This web section B passes through the printing unit 12 in which the second print image is transferred onto the web section B. After the print image has been accepted by the endless carrier material, the transport device 10 conveys the second web section B to the fixing station 16. In the fixing station 16, the second print image is fixed on the second web section B, which is subsequently stacked on a second stack 24 by the second deflection unit 20.

Two different embodiments of a printing unit that are employed in the printer disclosed above are described in detail below.

Figure 5:
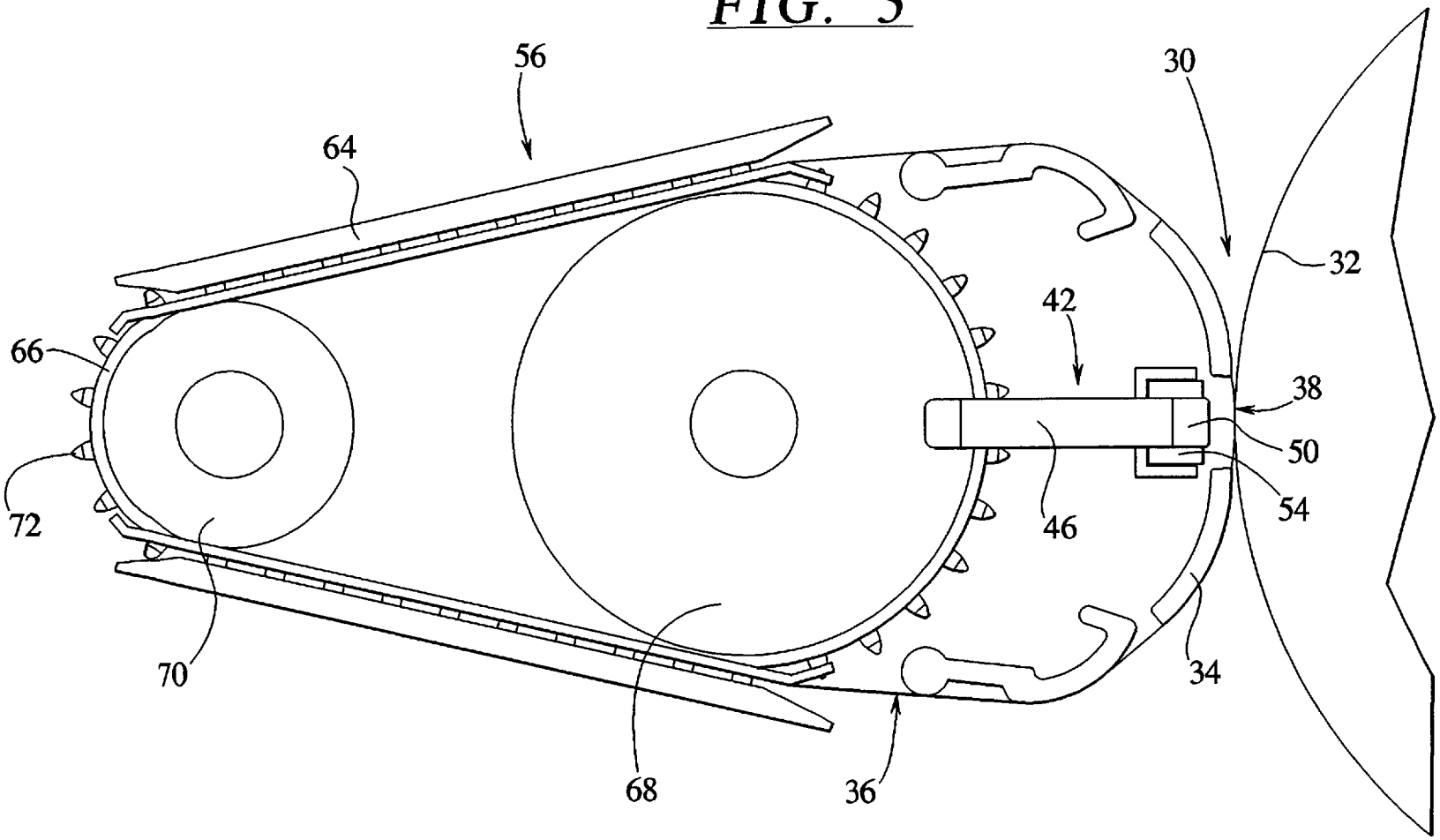
FIG. 5 is a side view of a first exemplary embodiment of a printing unit.

FIG. 5 shows a side view of a first embodiment of a printing unit 30 with a photoconductor drum 32 and a tensing or tension means 34 that pre-stresses a web 36 of endless carrier material against the photoconductor 32 during the printing process. A first corona device 40 (not shown in FIG. 5; see FIG. 6) and a second corona device 42 is arranged parallel to the longitudinal axis of the photoconductor 32 at a constant spacing therefrom at a transfer printing location 38 at which the web 36 lies against the photoconductor 32. The two corona devices 40 and 42 each have a respectively separate controllable voltage supply (not shown) with which the intensities of the electrical fields generated by the corona devices 40 and 42 can be matched to the properties of the material of the endless carrier material independently of one another. Each of the corona devices 40 and 42 has a cassette 44 or, respectively, 46 secured to the frame of the printer in which a corona wire 48 (FIG. 6) or, respectively, 50 (FIG. 7) is respectively wound up. A slide (or anchor) 52 or, respectively, 54 (FIG. 7) secured to the free end of each corona wire 48 or, respectively, 50 can be adjusted parallel to the longitudinal direction of the photoconductor 32, whereby the corona wire 48 or, respectively, 50 is pulled from the cassette 44 or, respectively, 46 or wound up into it. A cleaning device (not shown) in the cassette 44 or, respectively, 46 thereby cleans the corona wire 48 or, respectively, 50 pulled from the cassette 44 or, respectively, 46.

The web 36 is conducted past the printing unit 30 with a transport device 56 (FIG. 5). The transport device 56 has a total of four crawler units or tractor drive units 58, 60, 62 and 64, whereof only the fourth crawler unit or tractor drive unit 64, however, can be seen in FIG. 5, the structure thereof being identical to the structure of the tractor units 58, 60 and 62.

The crawler unit 64 has a transport belt 66 aligned in transport direction of the web 36 that is pulled on a drive wheel 68 having a larger diameter and that is keep under pre-stress with a tensing wheel 70 having a smaller diameter that is arranged at a distance from the drive wheel 68 in alignment therewith. A plurality of transport pins 72 are secured on the radially outwardly facing surface of the transport belt 66 following one another with equal spacing in transport direction. The transport pins 72 engage into transport holes 74 that are fashioned at the left and right edge of the web 36, likewise with constant spacing in transport direction.

Figure 6:
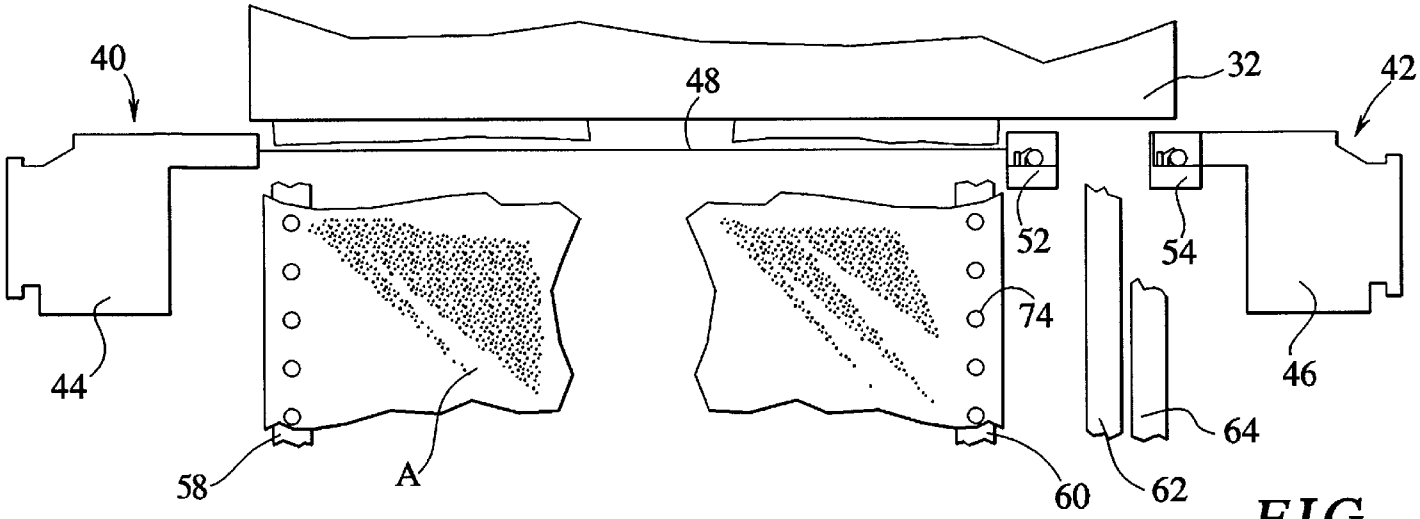
FIG. 6 is a plan view of the printing unit according to FIG. 5 when printing a web section extending over approximately the entire width of a photoconductor.
Figure 7:
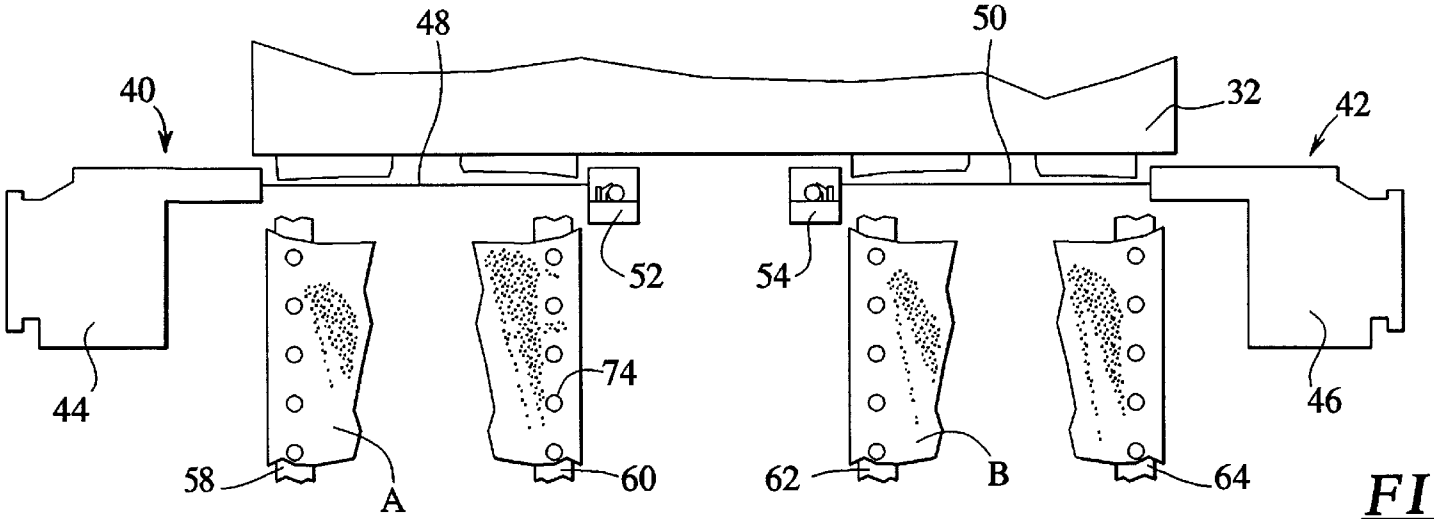
FIG. 7 is a plan view of the printing unit according to FIG. 5 when printing two web sections arranged spaced side-by-side.

FIGS. 6 and 7 show the printing unit 30 with the transport device 56 in plan view. FIG. 7 shows the printing unit 30 during the simplex mode wherein a first web section A of the web 36 extending over approximately the entire width of the photoconductor drum 32 is printed. In this operating mode, the two tractor units 62 and 64 are moved laterally beyond the printing region and are parked there, whereas the two crawler units 58 and 60 assume the transport of the web section A. To this end, the transport pins 72 of the first and second crawler unit 58 and 60 engage in transport holes 74 fashioned at the left and right edge of the web section A.

During the simplex mode, the corona wire 48 of the first corona device 40 is pulled from the cassette 44 with the slide 52 and is stretched at least across the entire width of the web section A. The field width of the electrical field generated by the first corona device 40 is determined by the length of the stretched corona wire 48. The slide 54 of the second corona device 42 lies against the cassette 46 in which the corona wire 50 is wound up, so that the second corona device 42 is not in operation.

FIG. 7 shows the printing unit 30 during the printing of two web sections A and B. The first web section A is transported by the first and second tractor unit 58 and 60, whereas the second web section B is conducted past the photoconductor drum 32 by the third and fourth tractor unit 62 and 64. In this operating condition, the slide 52 of the first corona device 40 is extended to such an extent that the corona wire 48 is stretched at least over the entire width of the first web section A. The slide 54 of the second corona device 42 is extended to such an extent that the corona wire 50 stretches over at least approximately the entire width of the second web section B.

The employment of the printing unit 30 makes it possible to print endless carrier material both in simplex mode as well as in parallel simplex mode, duplex mode or two-color simplex mode without the surface of the photoconductor drum 32 being directly exposed to the electrical field of the first or, respectively, second corona device 40 or, respectively, 42.

Figure 8:
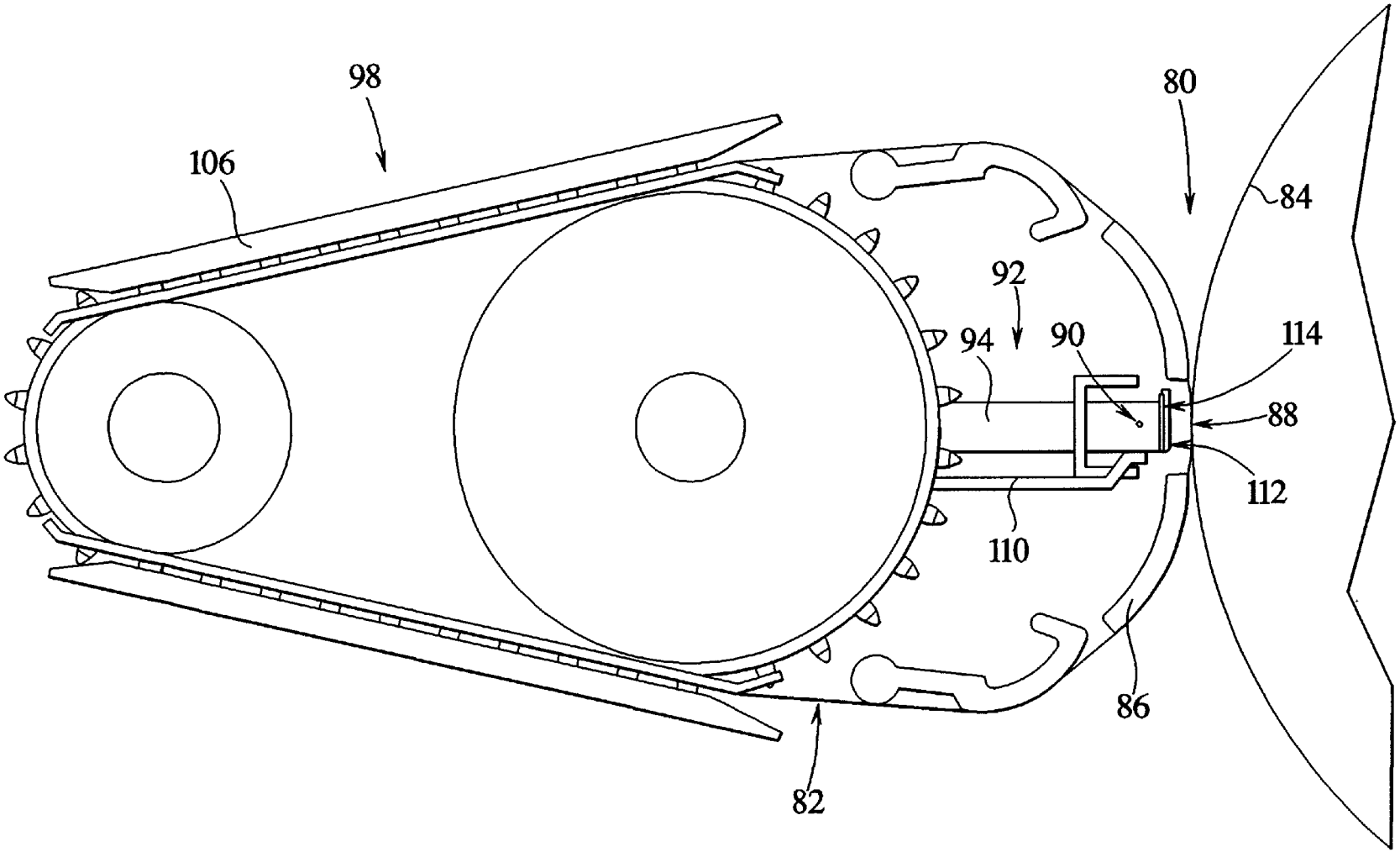
FIG. 8 is a side view of a second embodiment of a printing unit.

FIG. 8 shows a second embodiment of a printing unit 80 that conducts a web 82 of an endless carrier material past a photoconductor drum 84. During the printing event, a tension means 86 pre-stresses the web 82 against the photoconductor drum 84 such that the web 82 lies against the surface of the photoconductor drum 84 at a transfer printing location. At the back side of the web 82 facing away from the photoconductor drum 84, a corona wire 90 of a corona device 92 is stretched at a distance from the web 82, this corona wire 90 being wound up in a cassette 94 and being capable of being stretched parallel in longitudinal direction relative to the photoconductor drum 84 with a slide 96 (see FIGS. 9 and 10). A cleaning device (not shown) is accommodated within the cassette, this cleaning the corona wire 90 when it is wound up into the cassette 94 and unwound therefrom.

A transport device 98 transports the web 82 past the photoconductor drum 84. The transport device 98 has four tractor units 100, 102, 104 and 106 whose respective structure is the same as the structure of the tractor unit 64 according to FIG. 5, so that a detailed description can be foregone.

A respective boom 108 or, respectively, 110 projecting in the direction of the photoconductor drum 84 is screwed to the middle tractor units 102 and 104, a shield element 112 or, respectively, 114 of an electrically insulating material that is fashioned as a rectangular plate being screwed to the respective end of said boom facing toward the photoconductor drum 84. For protecting the photoconductor drum 84 against the electrical field generated by the corona wire 90, the two shield elements 112 and 114 are moved between the photoconductor drum 84 and the corona wire 90, whereby their flat sides facing toward one another lie against one another proceeding in vertical direction and overlap one another, as shown in FIG. 10.

Figure 9:
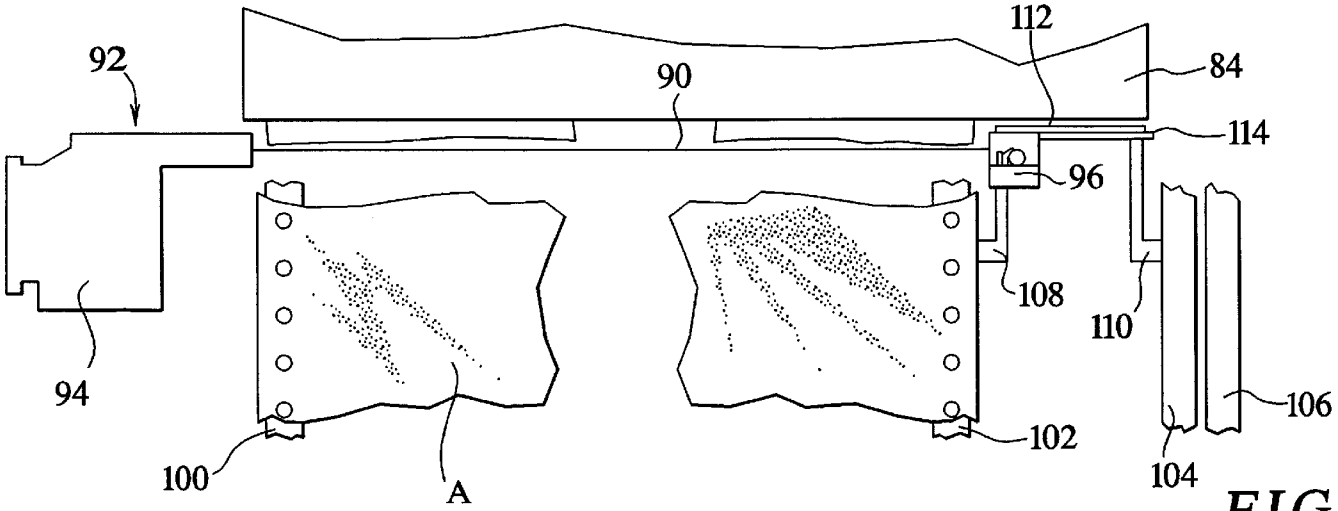
FIG. 9 is a plan view of the printing unit according to FIG. 8 when printing a web section extending over approximately the entire width of the photoconductor.

FIG. 9 shows the printing unit 80 in simplex mode, whereby a web section A of the web 82 whose width extends approximately over the entire width of the photoconductor drum 84 is printed. Given this printing event, the corona wire 90 is pulled from the cassette 94 of the corona device 92 with the assistance of the slide 96 and is stretched over at least approximately the entire width of the web section A parallel to the longitudinal direction of the photoconductor drum 84. In this operating position, the two crawler units 104 and 106 are moved laterally beyond the printing region and are parked thereat, whereby the boom 110 is moved along therewith. The transport of the web section A ensues via the tractor unit 100 and 102, whereby the boom 108 projects outward from the printing region. As a result of this motion, the two shield elements 112 and 114 are removed from the gap between the photoconductor drum 84 and the corona wire 90, so that a uniform electrical field is generated over the entire length of the photoconductor drum 84.

Figure 10:
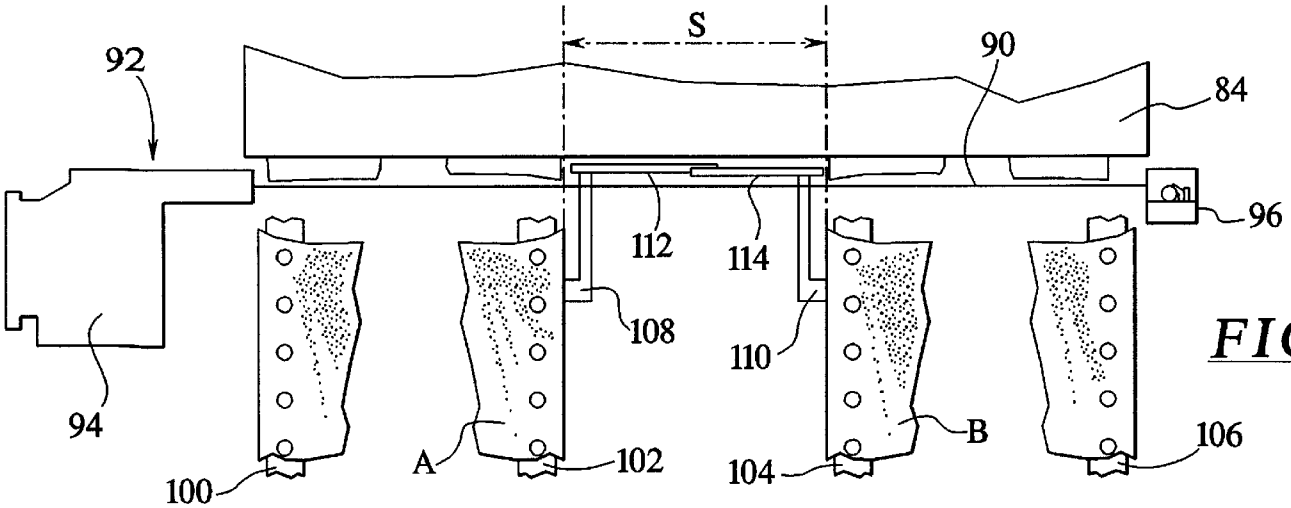
FIG. 10 is a plan view of the printing unit according to FIG. 8 when printing two web sections arranged spaced side-by-side.

In parallel simplex mode, duplex mode or two-color simplex mode, two web sections A and B are simultaneously printed, as shown in FIG. 10. The first web section A is transported with the two crawler units 100 and 102, and the second web section B is transported with the tractor units 104 and 106. When moving the tractor units 102 and 104, the booms 108 and 110 are co-moved, as a result whereof the two shield elements 112 and 114 are brought into a shielding position in which, as already explained above, they are arranged between the photoconductor drum 84 and the corona wire 90. During the printing event, the corona wire 90 generates a uniform electrical field over its entire length that transfers the toner from the photoconductor drum 84 onto the web sections A or, respectively, B. In the gap S between the two web sections A and B, the two shield elements 112 and 114 overlapping one another protect the photoconductor drum 84 against the electrical field, as a result whereof a non-uniform charging of the photoconductor drum 84 is prevented.

Since the shield elements 112 and 114 are connected to the middle crawler units 102 and 104 and are correspondingly co-moved given a lateral adjustment of the crawler units 104 or, respectively, 106, the shield width defined by the shield elements 112 and 114 will correspond to the gap S in every position of the crawler units 102 and 104.

When extremely narrow web sections A and B are printed, it is possible that the spacing between the crawler units 104 and 106 will have become so great due to the adjustment of the crawler units 104 and 106 that the width of the shield elements 112 and 114 no longer suffices for covering the gap S completely. In this case, an additional extension shield element (not shown) is attached to the shield elements 112 and 114 and secured thereat by engagement, as a result whereof the gap between the shield elements 112 and 114 is covered.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. An electro-graphic printer for printing toner images onto an endless web of carrier material, the web of carrier material having a width, the printer comprising:

a printing unit comprising a photo-conductor for transferring the toner images to the carrier material, the photo-conductor having an overall width, the printing unit further comprising a corona device comprising a corona wire having a length that is adjustable from a longer distance about equal to the overall length of the photo-conductor to a shorter distance less than or equal to the width of the web of carrier material, the corona wire being spaced from the photo-conductor, the printer further comprising a first pair of tractor drives including a first tractor drive and a second tractor drive and a second pair of tractor drives including a third tractor drive and a fourth tractor drive, the second tractor drive being disposed between the first and third tractor drives, the third tractor drive being disposed between the second and fourth tractor drives, each of said tractor drives being mounted on an opposing side of the corona wire from the photo-conductor, the second tractor drive being adjustably spaced from the first tractor thereby enabling the first and second tractor drives to engage opposing edges of a first section of the web and to feed said first section of the web between the corona wire and the photo-conductor, the third tractor drive being adjustably spaced from the fourth tractor drive thereby enabling the third and fourth tractor drives to engage opposing edges of a second section of the web and to feed said second section of the web between the corona wire and the photo-conductor, the second pair of tractor drives being spaced from the first pair of tractor drives thereby enabling said first and second sections of the web to be fed between the corona wire and photo-conductor simultaneously, the printer further comprising a shield having an adjustable shield width disposed between the second tractor drive and the third tractor drive and between the corona wire and the photo-conductor.

2. The printer of claim 1 wherein the length of the corona wire is adjustable to extend laterally across from the first tractor drive to the second tractor drive as well as from the first tractor drive to the fourth tractor drive.

3. The printer of claim 1 wherein the shield comprises a boom connected to the second tractor drive, the boom being connected to a shield element comprising an electrically insulating material that extends between the corona wire and a longitudinal axis of the photo-conductor.

4. The printer of claim 3 wherein the shield element has a length that is adjustable.

5. The printer of claim 1 wherein the shield comprises a first boom connected to the second tractor drive and a second boom connected to the third tractor drive, the first boom being connected to a first shield element comprising an electrically insulating material that extends towards the third tractor drive and between the corona wire and a longitudinal axis of the photo-conductor, the second boom being connected to a second shield element comprising an electrically insulating material that extends towards the second tractor drive and between the corona wire and a longitudinal axis of the photo-conductor, the first and second shield elements overlapping one another.

6. The printer of claim 3 wherein the first and second shield elements each have a length that is adjustable.

7. The printer of claim 1 wherein the corona device comprises a cassette for accommodating the corona wire on a spring loaded winding, the corona wire having a distal end that is connected to a slide element, the corona wire and slide element being extendable along the photo-conductor so that the corona wire extends from the first tractor drive to the second tractor drive or from the first tractor drive to the fourth tractor drive.

8. The printer of claim 7 wherein the slide element is selectively attachable to the second tractor drive or the fourth tractor drive.

9. The printer of claim 7 wherein the cassette comprises a cleaning element that engages the corona wire and cleans the corona wire as it is extended outward from the cassette and retracted inward into the cassette.

10. An electro-graphic printer for printing toner images onto an endless web of carrier material, the web of carrier material having a width, the printer comprising:

a printing unit comprising a photo-conductor, the photo-conductor having an overall width defined by first and second opposing ends, the printing unit further comprising a first corona device disposed at the first end of the photo-conductor and comprising a first corona wire having a length that is adjustable, the printing unit further comprising a second corona device disposed at the second end of the photo-conductor and comprising a second corona wire having a length that is adjustable, the first and second corona wires being spaced from the photo-conductor and being extendable longitudinally along the photo-conductor, the printer further comprising a first pair of tractor drives including a first tractor drive and a second tractor drive and a second pair of tractor drives including a third tractor drive and a fourth tractor drive, the second tractor drive being disposed between the first and third tractor drives, the third tractor drive being disposed between the second and fourth tractor drives, the first pair of tractor drives being mounted on an opposing side of the first corona wire from the photo-conductor, the second pair of tractor drives being mounted on an opposing side of the second corona wire from the photo-conductor, the second tractor drive being adjustably spaced from the first tractor thereby enabling the first and second tractor drives to engage opposing edges of a first section of the web and to feed said first section of the web between the first corona wire and the photo-conductor, the third tractor drive being adjustably spaced from the fourth tractor drive thereby enabling the third and fourth tractor drives to engage opposing edges of a second section of the web and to feed said second section of the web between the second corona wire and the photo-conductor, the second pair of tractor drives being spaced from the first pair of tractor drives thereby enabling said first and second sections of the web to be fed between the first and second corona wires and photo-conductor simultaneously.

11. The printer of claim 10 wherein the length of the first corona wire being adjustable to extend laterally across from the first tractor drive to the second tractor drive and the length of the second corona wire being adjustable to extend laterally across from the fourth tractor drive to the third tractor drive.

12. The printer of claim 10 wherein the first corona device comprising a first cassette for accommodating the first corona wire on a spring loaded winding, the first corona wire having a distal end that is connected to a first slide element, the first corona wire and first slide element being extendable along the photo-conductor so that the first corona wire extends from the first tractor drive to the second tractor drive, the second corona device comprising a second cassette for accommodating the second corona wire on a spring loaded winding, the second corona wire having a distal end that is connected to a second slide element, the second corona wire and second slide element being extendable along the photo-conductor so that the second corona wire extends from the fourth tractor drive to the third tractor drive.

13. The printer of claim 12 wherein the first slide element being attachable to the second tractor drive and the second slide element being attachable to the third tractor drive.

14. The printer of claim 12 wherein the first cassette comprises a cleaning element that engages the first corona wire and cleans the first corona wire as it is extended outward from the first cassette and retracted inward into the first cassette, and the second cassette comprising a cleaning element that engages the second corona wire and cleans the second corona wire as it is extended outward from the second cassette and retracted inward into the second cassette.

15. The printer of claim 10 the first corona device comprises a first power supply and the second corona device comprises a second power supply, the first power supply being separate from the second power supply.

16. An electro-graphic printer for printing toner images onto an endless web of carrier material, the web of carrier material having a width, the printer comprising:

a printing unit comprising a photo-conductor for transferring the toner images to the carrier material, the photo-conductor having an overall width, the printing unit further comprising a corona device comprising a corona wire having a length that is adjustable from a longer distance about equal to the overall length of the photo-conductor to a shorter distance less than or equal to the width of the web of carrier material, the corona wire being spaced from the photo-conductor, the printer further comprising a first pair of tractor drives including a first tractor drive and a second tractor drive and a second pair of tractor drives including a third tractor drive and a fourth tractor drive, the second tractor drive being disposed between the first and third tractor drives, the third tractor drive being disposed between the second and fourth tractor drives, each of said tractor drives being mounted on an opposing side of the corona wire from the photo-conductor, the second tractor drive being adjustably spaced from the first tractor thereby enabling the first and second tractor drives to engage opposing edges of a first section of the web and to feed said first section of the web between the corona wire and the photoconductor, the third tractor drive being adjustably spaced from the fourth tractor drive thereby enabling the third and fourth tractor drives to engage opposing edges of a second section of the web and to feed said second section of the web between the corona wire and the photo-conductor, the second pair of tractor drives being spaced from the first pair of tractor drives thereby enabling said first and second sections of the web to be fed between the corona wire and photo-conductor simultaneously, the length of the corona wire being adjustable to extend laterally across from the first tractor drive to the second tractor drive as well as from the first tractor drive to the fourth tractor drive, the printer further comprising a shield having an adjustable shield width disposed between the second tractor drive and the third tractor drive and between the corona wire and the photo-conductor, the shield comprising a first boom connected to the second tractor drive and a second boom connected to the third tractor drive, the first boom being connected to a first shield element comprising an electrically insulating material that extends towards the third tractor drive and between the corona wire and a longitudinal axis of the photo-conductor, the second boom being connected to a second shield element comprising an electrically insulating material that extends towards the second tractor drive and between the corona wire and a longitudinal axis of the photo-conductor, the first and second shield elements overlapping one another, the first and second shield elements each have a length that is telescopically adjustable, the corona device comprising a cassette for accommodating the corona wire on a spring loaded winding, the corona wire having a distal end that is connected to a slide element, the corona wire and slide element being extendable along the photo-conductor so that the corona wire extends from the first tractor drive to the second tractor drive or from the first tractor drive to the fourth tractor drive, the slide element being selectively attachable to the second tractor drive or the fourth tractor drive, the cassette further comprising a cleaning element that engages the corona wire and cleans the corona wire as it is extended outward from the cassette and retracted inward into the cassette.

* * * * *